US010121368B1

(12) United States Patent
Aladas

(10) Patent No.: US 10,121,368 B1
(45) Date of Patent: Nov. 6, 2018

(54) ADVANCED WIRELESS PUSH BUTTON FOR ACCESSIBLE PEDESTRIAN SYSTEM

(71) Applicant: Motaz Aladas, Ottawa (CA)

(72) Inventor: Motaz Aladas, Ottawa (CA)

(73) Assignee: KEY2ACCESS. INC

( * ) Notice: Subject to any disclaimer, the term of this patent is extended or adjusted under 35 U.S.C. 154(b) by 0 days.

(21) Appl. No.: 15/881,730

(22) Filed: Jan. 27, 2018

Related U.S. Application Data

(60) Provisional application No. 62/529,547, filed on Jul. 7, 2017.

(51) Int. Cl.

| | |
|---|---|
| ***G08G 1/095*** | (2006.01) |
| ***G08G 1/07*** | (2006.01) |
| ***G08C 17/02*** | (2006.01) |
| ***G08G 1/005*** | (2006.01) |

(52) U.S. Cl.
CPC ..... *G08G 1/07* (2013.01); *G08C 17/02* (2013.01); *G08G 1/005* (2013.01)

(58) Field of Classification Search
None
See application file for complete search history.

(56) References Cited

U.S. PATENT DOCUMENTS

| | | | | |
|---|---|---|---|---|
| 8,786,466 | B1 * | 7/2014 | Aladas | 340/944 |
| 9,672,732 | B1 * | 6/2017 | Aladas | G08C 17/02 |
| 2010/0039291 | A1 * | 2/2010 | Harrison | G08G 1/005 340/928 |
| 2016/0110998 | A1 * | 4/2016 | Todasco | G08G 1/07 340/944 |
| 2016/0180704 | A1 * | 6/2016 | Chang | G08G 1/005 340/944 |
| 2018/0025633 | A1 * | 1/2018 | Tate | G08G 1/005 |

* cited by examiner

*Primary Examiner* — Brent Swarthout

(57) ABSTRACT

A system for registering pedestrian signal requests comprising receivers configured to broadcast wireless messages, wherein a first field of a first receiver location information message is occupied by a first receiver angle code defined for a first receiver corresponding to a first crosswalk of a traffic intersection and a second field of the first receiver advertisement packet is occupied by a first special code corresponding to the first receiver. An advanced wireless push button is configured to enable a first button to identify any wireless message to be the first receiver message if the first receiver angle code is found in the first field. On activation of the first button the advanced wireless push button transmits the first receiver angle code and, on receipt of the first receiver angle code, first receiver registers a request for a pedestrian signal for the first crosswalk if a walk signal is found off.

20 Claims, 6 Drawing Sheets

ADVANCED WIRELESS PUSH BUTTON FOR ACCESSIBLE PEDESTRIAN SYSTEM

CROSS-REFERENCE TO RELATED APPLICATIONS

This application claims the benefit of U.S. Provisional Application No. 62/529,547, filed Jul. 7, 2017, the contents of which are incorporated herein by reference.

FIELD OF THE INVENTION

The present invention relates to traffic control systems. More particularly, the present invention relates to advanced wireless push button for accessible pedestrian system.

BACKGROUND OF THE INVENTION

Different types of pedestrian traffic signal systems are known in the art for facilitating pedestrian movement across pedestrian crosswalks on the streets. These systems allow a pedestrian to actuate the pedestrian signal by operating a switch to bring the flow of traffic to a halt and to permit her to cross the street safely. To make the pedestrian signal systems accessible and user friendly to the physically challenged pedestrians, various attempts have been made in the past. However, there was no pedestrian push button system available which could be activated from a distance. As a solution to this problem, a wireless push button device i.e. a remote for pedestrian crosswalk signal system was invented that was capable of making request for registration of pedestrian signal from a distance and for giving alert to the users of the remote to confirm WALK/DON'T WALK in the form of audible, tactile and visual signals. This wireless push button device for pedestrian crosswalk signal system is disclosed in detail in U.S. Pat. No. 8,786,466 issued Jul. 22, 2014 to the inventor and applicant of this present application. FIG. 1A illustrates an exemplary architecture of this invention 100. The receiver 102 of this invention cooperates with the existing traffic signal system 110 to enable a wireless device i.e. a remote 106 to initiate the activation of the pedestrian crosswalk signal system from a distance. The receiver 102 works in conjunction with the existing push button 108. When a button provided in the remote 106 is pressed it sends value of an angle of orientation of the remote with respect to the desired crosswalk direction. A compass included in the remote 106 calculates this angle value.

To provide the visually and/or hearing impaired pedestrians the same kind of facilities as those provided by the above mentioned wireless push button even without possessing the remote push button, an accessible pedestrian system 122, reference to system 120 shown in FIG. 1B, was invented. This integrated accessible pedestrian system is disclosed in detail in U.S. Pat. No. 9,672,732 issued Jun. 6, 2017 to the inventor and applicant of this present application. Here also, the remote 128 (i.e. wireless push button 128) depends on the compass provided in the remote to calculate the angle value for the direction in which the remote is held.

In both the above-mentioned systems, determination of the angle of orientation of the remote, with respect to a particular crosswalk direction, is crucial while making a request for activation of a pedestrian signal as the decision taken by the receiver to register such request for activation of a pedestrian signal gets influenced by the angle of orientation of the remote. Also, in the Integrated Accessible Pedestrian System mentioned above, the remote, with the help of the compass, assists a user in maintaining a correct path when the user walks through a crosswalk. Thus, accuracy of the angle value measured by the compass included in the remote has to be very high to make the system reliable. But, commercially available compasses may not give such accurate results. Also, a compass angle value measurement may get influenced by external factors such as static permanent magnetism, static induced magnetism etc.

Thus, there exists a need for a wireless push button which can perform its functions without depending on the angle of orientation measured by the compass.

Objects of the Invention

An object of the present invention to provide a system and method for an advanced accessible pedestrian system wherein dependency on compass of the remote can be eliminated for requesting registration of pedestrian signal in a specific direction.

Yet another object of the present invention is to provide a system and method for an accessible pedestrian system wherein navigational guidance can be given to a user throughout a crosswalk for maintaining proper path without being dependent on the compass of the remote.

These as well as other objects of the present invention are apparent upon inspection of this specification, including the drawings attached hereto.

SUMMARY OF THE INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The present invention is directed to an advanced wireless push button device which enables pedestrians to register a request for pedestrian signal from a distance and which helps the pedestrian maintain a correct path while crossing a street without depending on a compass for measuring the angle of orientation of the wireless push button device.

BRIEF DESCRIPTION OF THE DRAWINGS

In order to describe the manner in which features and other aspects of the present disclosure can be obtained, a more particular description of certain subject matter will be rendered by reference to specific embodiments which are illustrated in the appended drawings. Understanding that these drawings depict only typical embodiments and are not therefore to be considered to be limiting in scope, nor drawn to scale for all embodiments, various embodiments will be described and explained with additional specificity and detail through the use of the accompanying drawings in which.

DETAILED DESCRIPTION OF THE INVENTION

The following description is presented to enable any person skilled in the art to make and use the invention, and is provided in the context of particular applications of the invention and their requirements. Various modifications to the disclosed embodiments will be readily apparent to those skilled in the art and the general principles defined herein may be applied to other embodiments and applications without departing from the scope of the present invention. Thus, the present invention is not intended to be limited to the embodiments shown, but is to be accorded the widest scope consistent with the principles and features disclosed herein.

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as not to obscure the present invention.

Figure 2:
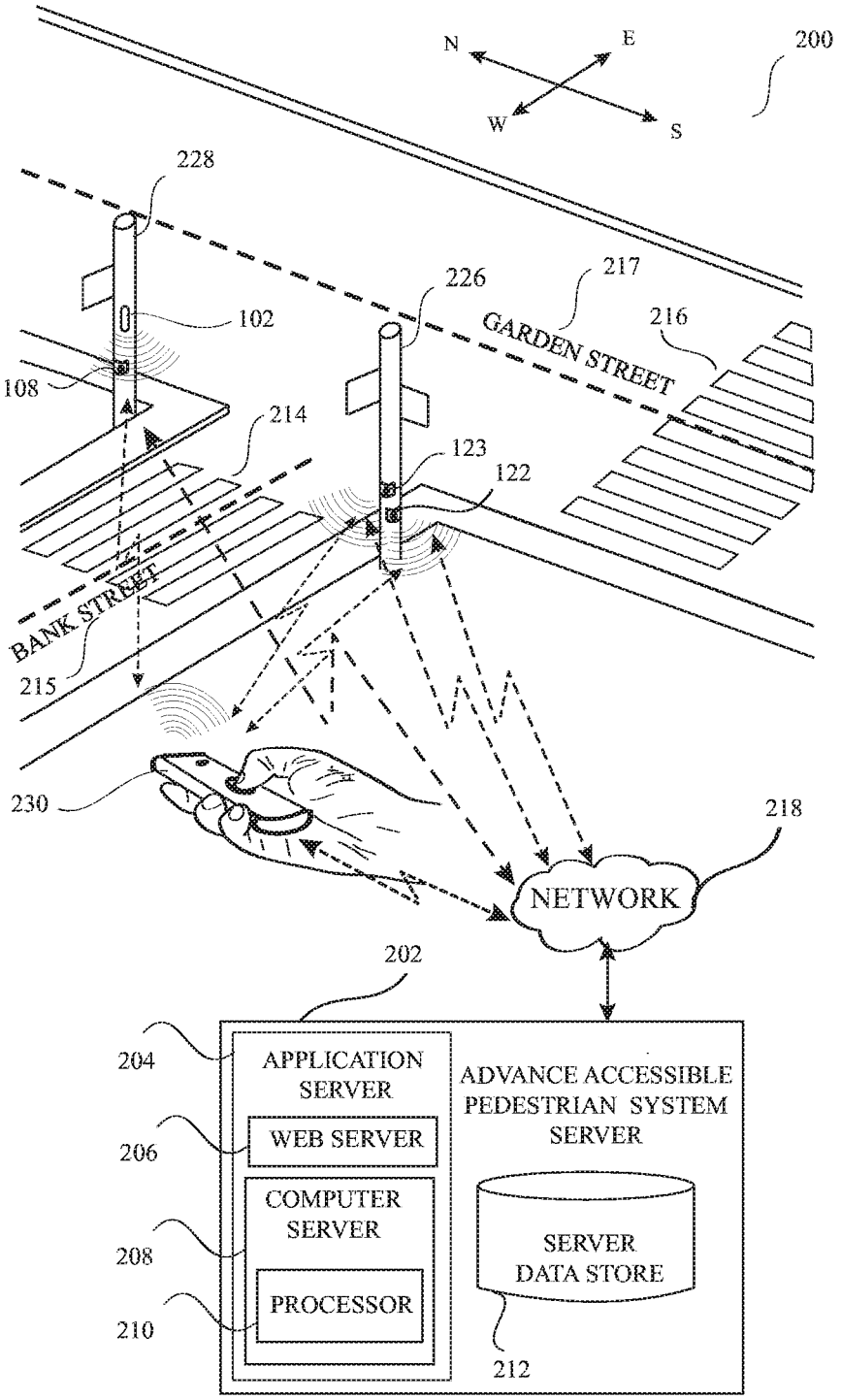
FIG. 2 a general environment for implementing the principles of the present invention.
Figure 3A:
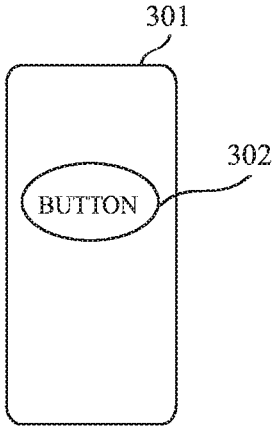
(PRIOR ART) FIG.3A
FIG. 3A illustrates a schematic diagram for a prior art wireless push button.
Figure 3B:
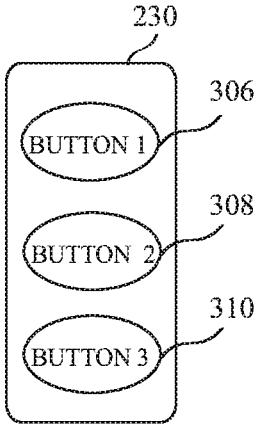
FIG. 3B illustrates a schematic diagram for a remote in accordance with an embodiment of the present invention.

FIG. 2 illustrates an advanced accessible pedestrian system 200 (advanced APS 200). The advanced integrated accessible pedestrian system 200 of the present invention includes one or more receivers 102 (receiver 102 is as per U.S. Pat. No. 8,786,466) connected to existing push button 108, one or more accessible pedestrian system (APS) 122 or 123 as disclosed in U.S. Pat. No. 9,672,732, one or more advanced wireless push button 230 and one or more advanced accessible pedestrian system server 202 (Advanced APS server 202). Hereinafter, the term "receiver" is used alternatively and interchangeably for both receiver 102 and APS 122 or 123. The advanced wireless push button 230 can be available in the form of an advanced remote 230 of FIG. 3B or it can be an application based advanced push button 230 of FIG. 3D.

Reference to FIG. 2, the advanced APS server 202 is communicatively connected with receiver 102, APS 122 and 123, and advanced wireless push button 230 over a network 218. The advanced APS server 202 can communicate with a mobile device to present a user interface for the app based advanced push button 230 of the present invention. The user interface of the advanced APS of the present invention can be presented on the mobile computing device through a web browser or through a native mobile application communicating with the advanced APS server 202 and is used for displaying, selecting a crosswalk direction and/or for managing data. As used herein, the term "network" generally refers to any collection of distinct networks working together to appear as a single network to a user. The term also refers to the so-called world wide "network of networks" or Internet which is connected to each other using the Internet protocol (IP) and other similar protocols. As described herein, the exemplary public network 218 of FIG. 2 is for descriptive purposes only and it may be wired or wireless. Although, the description may refer to terms commonly used in describing particular public networks such as the Internet, the description and concepts equally apply to other public and private computer networks, including systems having architectures dissimilar to that shown in FIG. 2. The inventive idea of the present invention is implementable in all existing cellular network topologies or respective communication standards, in particular GSM, UMTS/HSPA, LTE and future standards.

The components appearing in the advanced APS server 202 refer to an exemplary combination of those components that would need to be assembled to create the infrastructure in order to provide the tools and services contemplated by the present invention.

The advanced APS server 202 includes an application server or executing unit 204 and a data store 212. The application server or executing unit 204 comprises a web server 206 and a computer server 208 that serves as the application layer of the present invention. The Web server 206 is a system that sends out Web pages containing electronic data files in response to Hypertext Transfer Protocol (HTTP) requests from remote browsers or in response to similar requests made through a mobile app or mobile application of the present invention installed on a mobile computing device. The web server 206 can communicate with the mobile app of the present invention and/or with a web browser installed on a mobile computing device to provide the user interface required for the app based advanced push button.

The mobile application or "mobile app" is a computer program that may be downloaded and installed in a mobile computing device using methods known in the art. The advanced mobile app push button enables one or more persons to do various tasks related to the advanced APS of the present invention. Examples of mobile computing device may include, but not limited to mobile devices, tablets, hand-held or laptop devices, smart phones, personal digital assistants or any similar devices.

Figure 1A:
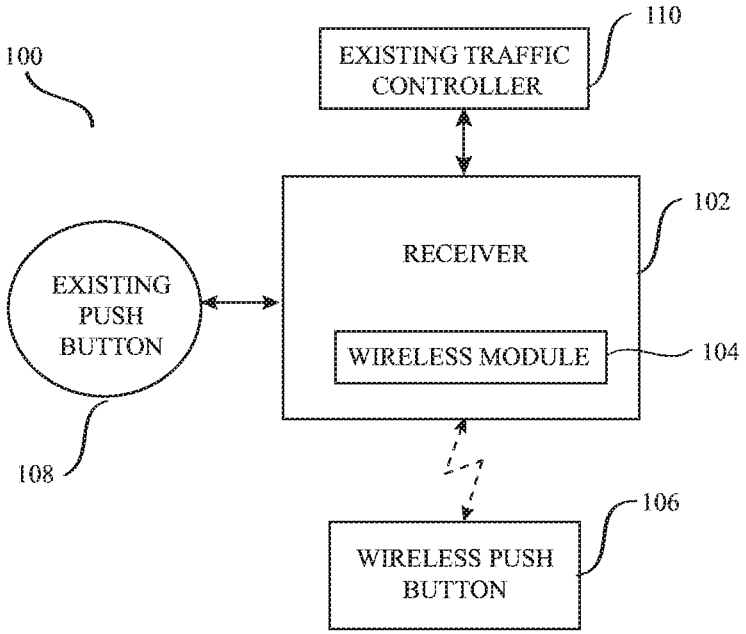
(PRIOR ART) FIG.1A
FIG. 1A is a block diagram of a prior art wireless push button device for pedestrian crosswalk signal system.
Figure 1B:
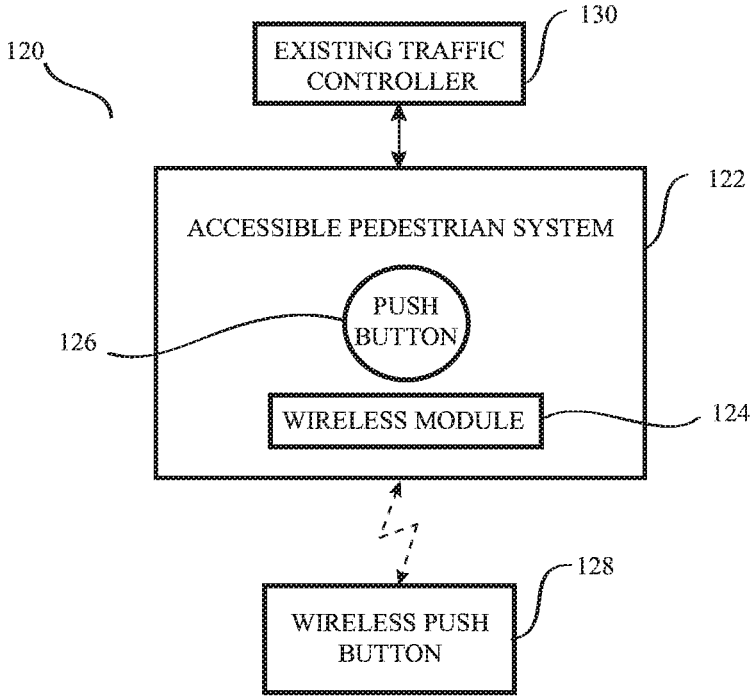
(PRIOR ART) FIG.1B
FIG. 1B is a block diagram of a prior art integrated accessible pedestrian system.

The wireless modules 104 or 124 of FIG. 1A and FIG. 1B of the receivers can include a Bluetooth module. Although, the system and method of the present invention is described hereinafter with reference to Bluetooth protocol or Bluetooth Low Energy protocol, it is to be understood that the concept of the present invention can be accomplished through other wireless protocols also such as through Wifi, Zigbee, UWB etc. The wireless module broadcasts Bluetooth Low Energy advertising packets. In another embodiment, the advertising packets can also be retrieved from the advanced APS server 202. Hereinafter, the terms "advertising packet", "advertising message", "wireless message", "beacon packet" and "beacon message" are used interchangeably and alternatively.

Reference to FIG. 2, in the exemplary environment, a receiver 102 is mounted on existing traffic signal pole 228 and two numbers of APS 122 and 123 are installed at traffic signal pole 226 wherein poles 226 and 228 are located at the opposite ends of crosswalk 214. In the present example, crosswalk 214 lies in the direction north-south. While receiver 102 and APS 123 are meant for crosswalk 214, APS 122 is meant for crosswalk 216 which lies in the east-west direction of the junction. Location information for each receiver and APS is stored in the respective receiver/APS locally as well as in the server data store 212 of the advanced APS server 202. The receiver location information for each receiver/APS includes its angle value/angle code/unique code, hereinafter referred to as receiver angle value code, with respect to the crosswalk directions where the receiver or APS is installed, location coordinates (e.g. GPS coordinates) of the receiver/APS and street name corresponding to the receiver/APS (e.g. names such as Bank Street 215 for the street on which crosswalk 214 is located and Garden Street 217 for the street on which crosswalk 216 is located) etc. It is to be understood that the angle value or angle code of a receiver/APS is not necessarily have to be the actual angle of orientation of the crosswalk. Rather, the angle value/code can be any value or code that can uniquely identify a particular receiver or APS. For example, angle value/code stored in the APS 122 for crosswalk 216 can be 30 degrees and, for crosswalk 214, the angle value/code stored in APS 123 can be 120 degrees. For receiver 102, the angle value/code stored could be 300 degrees for crosswalk 214 for the direction north-south. Also, the location coordinates (first receiver location coordinates) of APS 122 can be (X1, Y1), location coordinates (second receiver location coordinates) of APS 123 can be (X2, Y2) and location coordinates (third receiver location coordinates) of receiver 102 can be (X3, Y3).

As discussed in the prior art U.S. Pat. No. 9,672,732, the different types of wireless messages transmitted/broadcasted by the receiver/APS may comprise different types of messages. As a first type of message, the receiver and APS broadcast their respective angle values/codes and location coordinates in the advertisement packets. The advertisement packets can also include a code/value for a predetermined acceptable range of angle values corresponding to the receiver angle value. Additionally, in accordance with an embodiment of the present invention, the advertisement packets can also have a special code placed at a desired position in the advertisement packet to help the advanced wireless push button find the angle value relevant and thus the relevant message for a particular direction of crosswalk/street. While the present invention is described hereinafter by giving an exemplary format for the wireless message i.e. advertising packet, it would be obvious to those skilled in the art that any suitable protocol can be adopted to implement the present invention as long as the receiver/APS, the advanced wireless push button, the advanced APS server and the network are configured to understand and abide by the protocol adopted. Accordingly, when a field position in a data packet of a wireless message is referred to hereinafter as first field or a second field or any other field position, it is to be understood that such positions in a packet or message can be relative positions which are identified or treated in the same manner by all the components of the system (e.g. the receivers/APSs, the server and the wireless push button). In a preferred embodiment, the first field in the format for first receiver location information message broadcasted by the first receiver is occupied by or identifies the first angle value (i.e. first receiver angle code) stored for a first crosswalk of a first street defined for a traffic intersection. Similarly, in the second receiver location information message broadcasted by the second receiver, the second field of the advertisement packet format is occupied by the second receiver angle value (i.e. the second receiver angle code). For example, if the APS 122 is defined as the first receiver/APS (crosswalk 216 being in the east-west direction with first angle value or first angle code 30), the advertisement packet i.e. the first receiver location information message transmitted by APS 122 can be in the format 30, 500, 10 wherein the first field is occupied by the first receiver angle code 30 and the second field is occupied by an arbitrary special code (also referred to hereinafter as first special code) having a value more than 360, for example, and the predetermined acceptable angle range value 10 occupies the third field. Similarly, the APS 123 can be defined as the second receiver/APS (crosswalk 214 being in the north-south direction with second angle value or second angle code 120), the advertisement packets i.e. the second receiver location information message transmitted by APS 123 (second receiver) can be in the format 500, 120, 10 wherein the first field is occupied by the special code 500 (also referred to hereinafter as second special code which can be any number above 360, for example), the second field is occupied by the second receiver angle code 120 and the third field is occupied by the predetermined acceptable angle range value 10. An advertisement packet i.e. a third receiver location information message broadcasted by the third receiver 102 can have the angles and codes in the order/format 300, 500, 10. Here, the number included in the first field indicates the third receiver angle value i.e. the third receiver angle code for third receiver 102, the number indicated in the second field is the special code and the number indicated in the third field is the acceptable range of angle values. Thus, for the first receiver location information message broadcasted by the first receiver, the first special code is placed at the second field of the advertisement packet, and, for the second receiver location information message broadcasted by the second receiver, the second special code is placed at the first field of the second receiver location information message. In a preferred embodiment, the special code is any number above 360 so that the advanced wireless push button can identify it as the special code considering the fact that the maximum possible receiver angle value transmitted by a receiver or APS cannot exceed a value of 360 degrees. A second type of wireless message broadcasted by the receiver/APS may include information specific to the location of the receiver and this type of message enables the wireless push button to retrieve related information from a the advanced APS server 202.

The working principle of the present invention is described hereinafter taking an example of a person approaching a traffic intersection with intent to cross the Bank Street 215 through second crosswalk 214 from the traffic pole side 226 as shown in FIG. 2. The pedestrian can use the advanced wireless push button 230 to register a request for pedestrian signal for the second crosswalk 214 from a distance.

Figure 4:
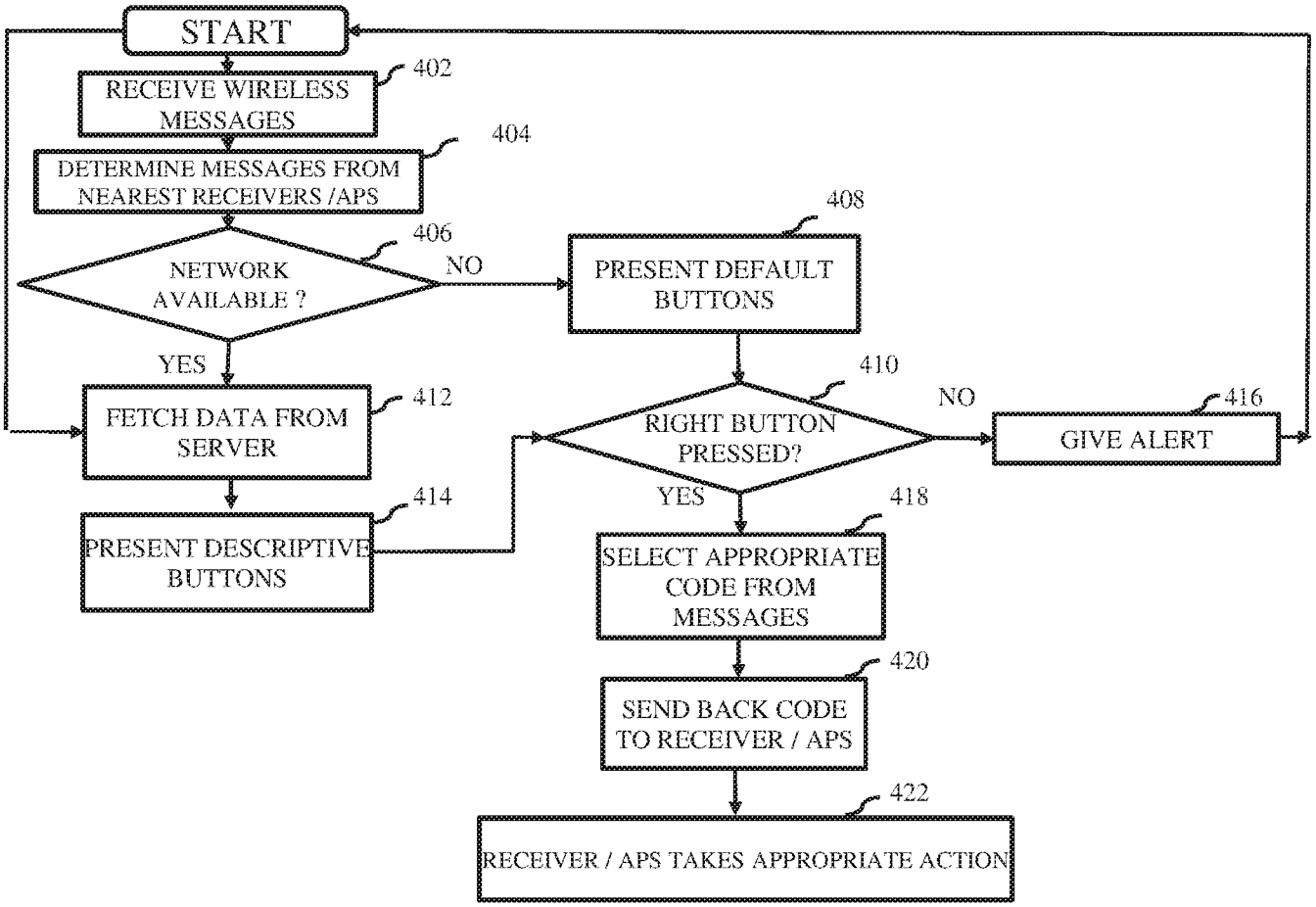
FIG. 4 shows a flow diagram illustrating the functioning of the app based advanced push button in accordance with an embodiment of the present invention.
Figure 5:
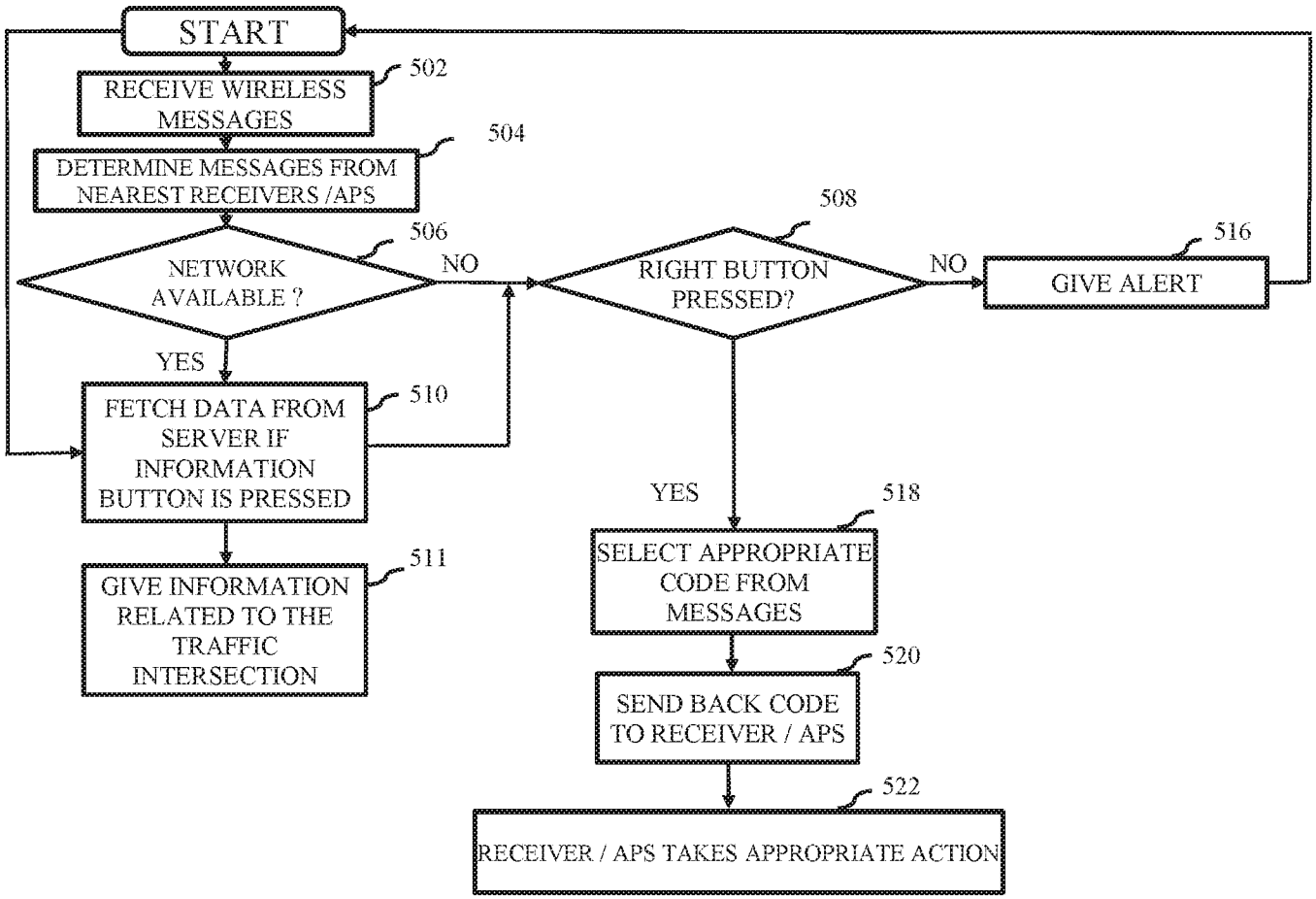
FIG. 5 shows a flow diagram illustrating the functioning of the advanced remote in accordance with an embodiment of the present invention.

As soon as the advanced wireless push button 230 is carried near the traffic signal pole 226 it starts receiving wireless messages i.e. the advertisement packets transmitted by the receiver and the APSs as in step 402 of FIG. 4 or in step 502 of FIG. 5, as applicable depending on the type of advanced wireless push button being used. In another embodiment, reference to FIG. 6, the advanced wireless push button 230 transmits its location coordinates to the advanced APS server 202 as in step 602. Since, the advanced APS server 202 is aware of the location coordinates of the receivers, it finds the receivers located near the location coordinates of the advanced wireless push button 230 and, then, the advanced APS server 202 transmits the location coordinates of the nearby receivers to the advanced wireless push button 230 as in step 604.

Among all the advertisement packets received by the advanced wireless push button 230, be it from the receivers directly or from the advanced APS server, it ignores those advertisement packets which come from the receivers located beyond a predetermined distance from the advanced wireless push button 230 as in step 404 or in step 504 or in step 606. In some embodiments, based on the location information, the advanced wireless push button 230 identifies the receiver(s) of interest by the unique identifier(s) parameters (e.g. UUID, Major and Minor etc.) assigned to the receiver(s) of a particular traffic intersection. This step makes sure that the advanced wireless push button 230 does not take the advertisement packets coming from receivers/APSs installed on the other sides of the streets into consideration and further processes the advertisement packets received from the nearest receivers/APSs only. The transmission power i.e. TX power of an advertisement packet and the RSSI (Received Signal Strength Indication) value can be used to determine the distance of the source receiver/APS of the transmitted packet from the advanced wireless push button 230. Thus, in the present example, the advanced wireless push button 230 ignores advertisement packet transmitted by receiver 102 since the receiver 102 is located beyond the predetermined distance from the advanced wireless push button 230 when the pedestrian is waiting near traffic pole 226.

In a preferred embodiment, one or more buttons are provided by the advanced wireless push button 230 each of which can be individually associated dynamically with a particular crosswalk/street with respect to a location and direction of a street, preferably in terms of the angle value or unique identity/code recorded in a receiver/APS for that particular crosswalk. In some embodiments, one or more buttons of the plurality of buttons can be configured to perform other functions. For every traffic intersection, a receiver/APS installed for a first crosswalk in a particular direction (e.g. crosswalk in the east-west direction) can be defined as a first receiver and the receiver angle code stored in it for the first crosswalk can be defined as the first receiver angle value or first receiver angle code. Similarly, for the second crosswalk (e.g. crosswalk in the north-south direction) of the intersection, the receiver/APS installed can be defined as the second receiver/APS and the angle value/code stored for this second crosswalk can be defined as the second receiver angle value or second receiver angle code. For example, reference to FIGS. 3A and 3B, while the prior art remote 301 had only one button 302 on it and the same button had to be pressed while selecting different crosswalks/streets, the advanced remote 230 of the present invention has three buttons—button 1 (first button), button 2 (second button) and button 3 (third button) indicated by reference numerals 306, 308 and 310 respectively. In one embodiment, button 1 can be associated with a first street/first crosswalk/first receiver (e.g. associated with an angle code included in the first field of the advertisement packet and the angle code has an angle value less than or equal to 360 degrees), button 2 can be associated with a second street/second crosswalk/second receiver (e.g. associated with an angle code included in the second field of the advertisement packet and the angle code has an angle value less than or equal to 360 degrees) and button 3 can be used to retrieve information related to the traffic intersection such as street names, location of the traffic signal etc. from the advanced APS server 202 or from the receiver. These information can be played on speaker connected to the receiver or the APS. Here, the association of a particular button with a particular street/crosswalk/receiver is dynamic meaning this association changes as the advanced wireless push button is moved from one traffic intersection to another intersection. However, in a preferred embodiment, the first button can be configured to be associated always with the crosswalk/street of east-west direction (i.e. first crosswalk) and the second button can always be configured to be associated with the crosswalk/street of north-south direction (i.e. second crosswalk) in terms of their angle values. When the association is not clear to the user, they can press on button 3 and the speakers will play the name of the intersection and the association will be clear to the user. The association of the buttons with the crosswalks or angle values is done in similar fashion in case of the app based advanced push button. However, in the case of the app based advanced push button of the present invention, the user interface presents a plurality of descriptive buttons on the display and each of these buttons can represent a pedestrian push button along with information (such as name of the street on the display) related to the respective street/crosswalk to which a button is associated with in a given instance of time.

Figure 3C:
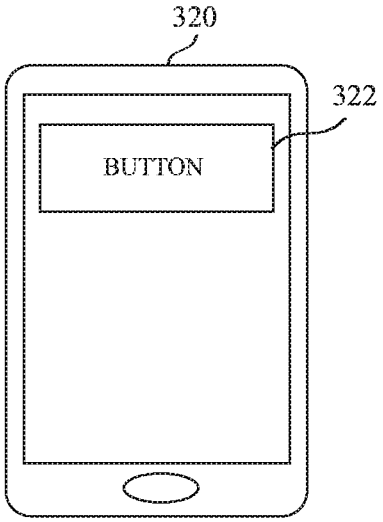
(PRIOR ART) FIG.3C
FIG. 3C illustrates an exemplary user interface for a prior art app based wireless push button incorporated through a mobile application installed on a mobile device.
Figure 3D:
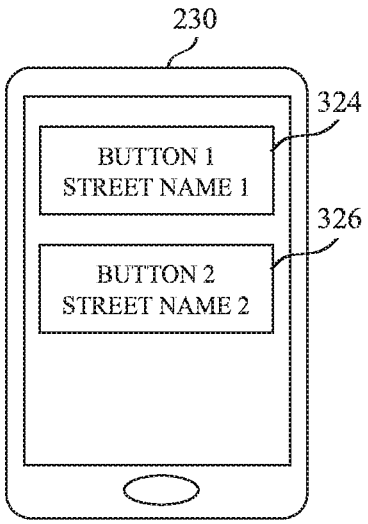
FIG. 3D illustrates an exemplary user interface for an app based wireless push button incorporated through a mobile application installed on a mobile device in accordance with an embodiment of the present invention.

FIG. 3C shows a prior art app based push button 322 presented on the display of mobile device 320. Similar to button 302 of the remote 301, the prior art app based push button 322 cannot provide street-wise selection button as it has only one button on the user interface presented on mobile device 320. On the other hand, the app based advanced push button presents street-wise selectable pedestrian buttons such as button 1 with its associated street name 1 and button 2 with its associated street name 2 as indicated by reference numerals 324 and 326 respectively in FIG. 3D.

In the present example, when the pedestrian holds the app based advanced push button 230 near the traffic pole 226, the app searches for availability of network connection as in step 406. If network connection is found then the app retrieves the details of the traffic intersection from the advanced APS server 202 as in step 412. In some embodiment, the app based advanced push button 230 may receive information of many traffic intersections in the area. Then it listens to advertisement from the receiver or the APS to know which one of these intersections to use based on the unique identifiers assigned to the receiver/APS of that traffic intersection. The app based advanced push button then displays two buttons—first button (button 1) with name of the street as Garden Street and second button (button 2) with name of the street as Bank Street as in step 414 of FIG. 4 or in step 608 of FIG. 6. If no network connection is found then the buttons are displayed with default nomenclature of Street 1 and Street 2 as in step 408. If only one crosswalk is available then only one push button is displayed on the user interface. In some embodiments, the descriptive buttons 324 and 326 are constructed based on the information received from the advertisement packets.

If the pedestrian is using an advanced remote 230, and if network connection is found as in step 506 of FIG. 5, the pedestrian can press the third button 310 (information button 310) of the advanced remote 230 to retrieve the location specific information from the advanced APS server 202. On doing this, the advanced remote 230 gives audible information related to the traffic intersection including names of the streets as in step 511.

In the present example, the pedestrian has now two options—to activate the first button (button 1) or to press the second button (button 2). The advanced wireless push button of the present invention allows activation of a button through voice command also. Since, the pedestrian of the present example wants to cross the Bank Street, the second button should be activated (either by physically touching/pressing the button or through voice command). However, if the right button is not activated as in step 410 of FIG. 4 or in step 508 of FIG. 5 or in step 610 of FIG. 6, and if the pedestrian activates button 1 while facing Bank Street, the advanced wireless push button 230 gives audible/tactile/visual alert to the user as in step 416 or in step 516 of FIG. 5 or in step 612 of FIG. 6 to indicate that the user selected Garden Street instead of Bank Street.

Even after ignoring the advertisement packets transmitted by the receiver 102 on the basis of distance or some other identifier, the advanced wireless push button 230 in the present example has two types of packets to choose from and respond to—the advertisement packets received from the APS 122 in the format 30, 500, 10 and the other advertisement packets received from the APS 123 in the format 500, 120, 10. As per the rules followed for configuration of the receiver/APS, Garden Street is considered as First Street (street of the first crosswalk in the east-west direction) and Bank Street is considered as Second Street (street of the second crosswalk in the north-south direction). Accordingly, angle value/code 30 degree for the crosswalk 216 on the Garden Street is considered as the first receiver angle code, and angle value/code 120 degree of the crosswalk 214 on the Bank Street is considered as the second receiver angle code. The advanced wireless push button 230 is configured to enable the first button to identify any wireless message received by it to be the first receiver location information message if the first receiver angle code is found in the first field. Similarly, the advanced wireless push button 230 is configured to enable the second button to identify any wireless message received by it to be the second receiver location information message if the second receiver angle code is found in the second field of the second receiver location information message. For both first and second button, a valid angle code or valid angle value is any value that lies within 360 degrees in the present example. Therefore, if the second button is pressed/selected/activated in step 410 or in step 508 or in step 610, the advanced wireless push button 230 looks for an wireless massage (advertisement packet) having a valid angle value or a valid code included in the second field of the received packet format. In the present example, the first receiver location information messages broadcasted by the first receiver are not acceptable for the advanced wireless push button 230 when the second button is pressed as the second field in the format of these first receiver location information messages is occupied by a number 500 (packet is 30, 500, 10) which is considered as an invalid value/number/code by the advanced wireless push button. So, the advanced wireless push button 230 chooses the second receiver location information message received from the second APS i.e. APS 123 (second receiver) when the second button is pressed as it finds a valid second angle code of 120 at the second field of the packet (packet is 500, 120, 10) as in step 418 of FIG. 4 or in step 518 of FIG. 5 or in step 614 of FIG. 6 as an acceptable number/value/code.

Figure 6:
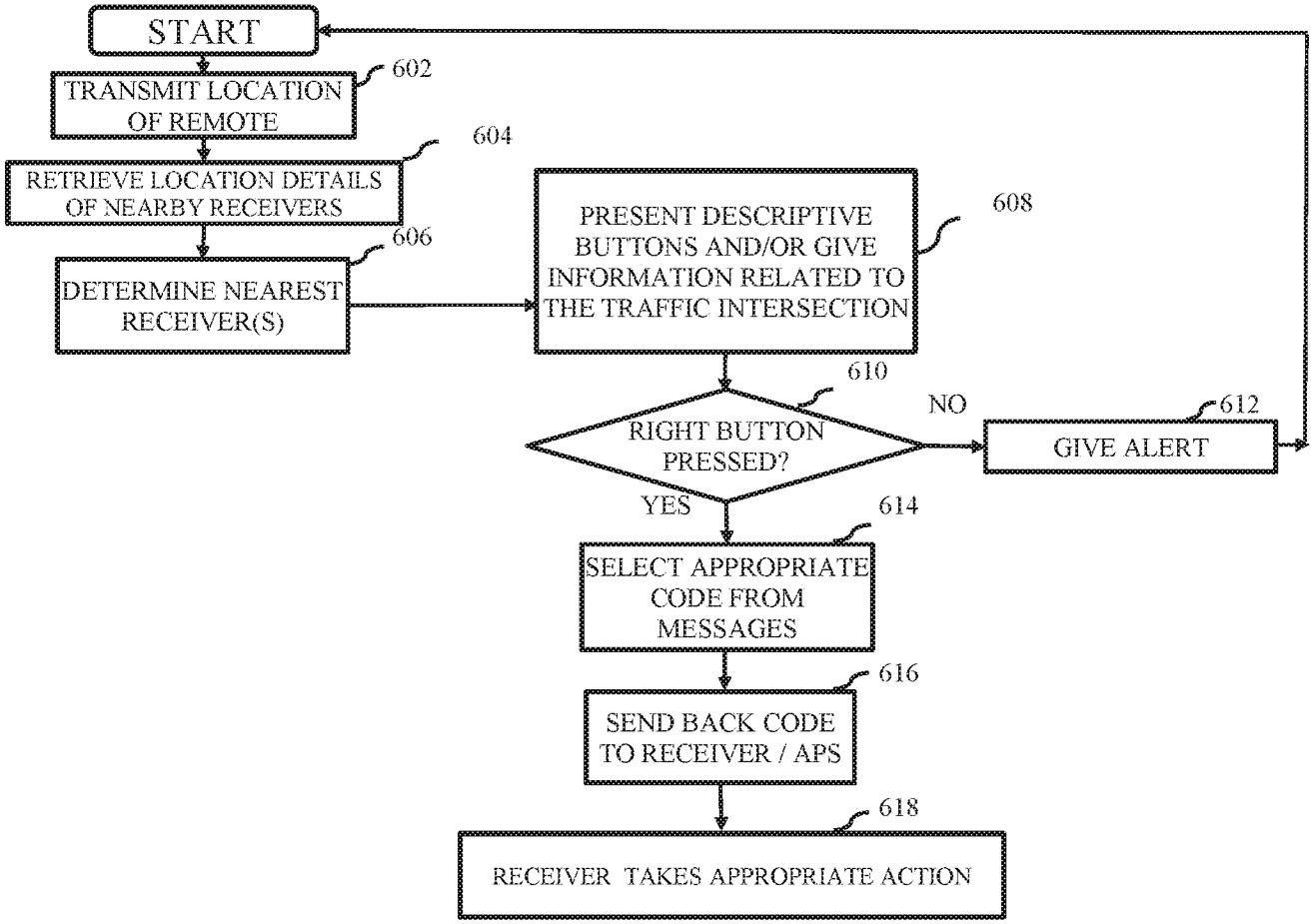
FIG. 6 shows a flow diagram illustrating the functioning of the advanced wireless push button when the location information of the receivers is retrieved from the server in accordance with an embodiment of the present invention.

The advanced wireless push button 230 then transmits the selected code or angle value back to the receiver/APS as in step 420 of FIG. 4 or in step 520 of FIG. 5 or in step 616 of FIG. 6. In the present example, on selecting second button for the crosswalk 214 on Bank Street, the advanced wireless push button 230 sends the selected second angle code 120 back. On receiving this angle value, APS 123 understands that the pedestrian is requesting for registration of pedestrian signal in the crosswalk direction 214 and it takes action in this regard as appropriate as in step 422 of FIG. 4 or in step 522 of FIG. 5 or in step 618 of FIG. 6. A communication channel or a session is thus established through a handshake between the advanced wireless push button 230 and the APS 123. The APS 122 i.e. the first APS/receiver would ignore the transmission from the advanced wireless push button in this example since 120 is not a valid angle value/code defined for the first crosswalk 216 in APS 122.

The APS 123 i.e. the second receiver, after receiving the request for registration of a pedestrian signal from the wireless push button 230, will establish a communication/transmission session with the advanced wireless push button 230 and acknowledge that a session has been established. The receiver/APS 123 will determine a status of the pedestrian signal in the crosswalk direction 214 and register a pedestrian signal request if a walk signal of the pedestrian signal is not on (i.e. the DON'T Walk signal is on) in the crosswalk direction 214 as per said status of pedestrian signal and provide an acknowledgement in the form of one or more types of audible/visual/tactile alerts corresponding to the status of pedestrian signal. This acknowledgement with regard to successful registration of a pedestrian signal request for a particular street, for example, can be in the form of textual confirmation message with the name of the street displayed on the advanced wireless push button 230. Since, a session has already been established between the advanced wireless push button 230 and the APS 123 in the present example, the APS 123 will keep on updating the advanced wireless push button 230 with regard to the status of the requested pedestrian signal. If the WALK is on when the APS 123 receives the request from the advanced wireless push button, or when the WALK is turned on after registering a request and establishment of a session, the advanced wireless push button 230, along with the APS 123 provides a number of audible/tactile/visual alerts specific to the street/crosswalk of interest to help the pedestrians cross the street. In a preferred embodiment, once the advanced wireless push button establishes a connection with a particular receiver, the receiver can provide one or more navigational alerts to the user (through the receiver itself or through the remote) in passing through an intended crosswalk without deviating from the crosswalk if the user keeps on pressing the appropriate button of the advanced wireless push button. To do so, the advanced wireless push button can make use of the location coordinates of the receivers installed at the opposite ends of a crosswalk. For example, for the second crosswalk 214, second receiver/APS 123 and third receiver 102 are installed at the opposite ends. So, when the WALK pedestrian signal is on for the second crosswalk 214 and the user walks through the second crosswalk 214 while continuously pressing the second button on, the advanced wireless push button monitors the direction of path traveled by it using the location coordinates or angle values of the second receiver and the third receiver. If the advanced wireless push button finds that it has deviated from the intended path (the second crosswalk in the present example) it will give one or more types of alerts. Thus, in the present example, the advanced wireless push button assists the user in maintaining an alignment of movement along the second crosswalk based on second receiver location coordinates and third receiver location coordinates obtained from the plurality of wireless messages.

In another embodiment, the advanced wireless push button provides navigational guidance to the user of the advanced wireless push button to cross the street safely. To use this feature, the user has to point the camera of the mobile device on which the mobile app of the present invention is installed to the direction of the traffic pole head located on the other side of the crosswalk which the user wants to cross. The camera of the mobile device is then required to be pointed to the crosswalk markings while crossing the street. The mobile app of the present invention configures the mobile device to take note of the location of the pole of the opposite end and then to continuously monitor the alignment of the movement of the mobile device with respect to the markings of the crosswalk as captured by the camera. Any deviation from the expected path found by the mobile device triggers alert to the user. In some embodiments, a machine readable unique identifier can be placed on the traffic poles or on the receivers/APSs which can help the mobile app identify a particular traffic pole/receiver for navigational guidance purpose.

As can be seen above, the advanced wireless push button of the present invention carries out its functions without depending on the calculation of orientation of the advanced wireless push button by a compass.

Flowchart is used to describe the steps of the present invention. While the various steps in this flowchart are presented and described sequentially, some or all of the steps may be executed in different orders, may be combined or omitted, and some or all of the steps may be executed in parallel. Further, in one or more of the embodiments of the invention, one or more of the steps described above may be omitted, repeated, and/or performed in a different order. In addition, additional steps, omitted in the flowchart may be included in performing this method. Accordingly, the specific arrangement of steps shown in FIGS. 4, 5 and 6 should not be construed as limiting the scope of the invention.

What is claimed is:

1. A method for registering pedestrian signal requests in an advanced accessible pedestrian system, said system comprising one or more receivers configured to transmit and receive a plurality of wireless messages and an advanced wireless push button, said method comprising:

transmitting, by a first receiver of said one or more receivers, a first receiver location information message of said plurality of wireless messages, wherein, corresponding to a first crosswalk defined for a traffic intersection, said first receiver location information message includes a first receiver code;

configuring said advanced wireless push button comprising a plurality of buttons and said plurality of wireless messages to dynamically dedicate one or more buttons of said plurality of buttons individually to a particular crosswalk of said traffic intersection;

enabling a first button of said one or more buttons to recognize said first receiver code on an activation of said first button by a user for making a request for a pedestrian signal corresponding to said first crosswalk;

transmitting back said first receiver code by said advanced wireless push button on said activation of said first button;

establishing a transmission session between said advanced wireless push button and said first receiver on receipt of said first receiver code by said first receiver; and determining, by said first receiver, a status of said pedestrian signal corresponding to said first crosswalk and registering said request for said pedestrian signal corresponding to said first crosswalk if a walk signal of said pedestrian signal for said first crosswalk is not on.

2. The method as in claim 1, further comprising:

transmitting, by a second receiver of said one or more receivers, a second receiver location information message of said plurality of wireless messages, wherein, corresponding to a second crosswalk defined for said traffic intersection, said second receiver location information message includes a second receiver code and a second receiver location coordinates;

configuring said advanced wireless push button and said plurality of wireless messages to enable a second button of said one or more buttons to recognize said second receiver code on an activation of said second button by said user for making a request for a pedestrian signal corresponding to said second crosswalk;

transmitting back said second receiver code by said advanced wireless push button on said activation of said second button; and determining, by said second receiver on receipt of said second code, said status of said pedestrian signal corresponding to said second crosswalk and registering said request for said pedestrian signal corresponding to said second crosswalk if said walk signal of said pedestrian signal for said second crosswalk is not on.

3. The method as in claim 1, wherein said advanced wireless push button ignores any of said plurality of wireless messages which comes from beyond a predetermined distance from said advanced wireless push button.

4. The method as in claim 1, wherein said advanced wireless push button is an application based advanced push button and said plurality of buttons are descriptive buttons displayed by said application based advanced push button.

5. The method as in claim 1, wherein an acknowledgement is sent by said first receiver to said advanced wireless push button after said registration of said request for said pedestrian signal.

6. The method as in claim 5, wherein said status of said pedestrian signal is continuously provided through said advanced wireless push button as long as said first button is kept activated.

7. The method as in claim 1, wherein a third button of said plurality of buttons retrieves an information related to said traffic intersection from said first receiver or from an advanced accessible pedestrian system server and said advanced wireless push button plays said information.

8. The method as in claim 2, wherein said plurality of wireless messages includes a third receiver location information message comprising a third receiver code, a third receiver location coordinates and a third special code corresponding to a third receiver installed opposite to said second receiver for said second crosswalk.

9. The method as in claim 8, wherein said advanced wireless push button provides one or more types of alerts to said user for maintaining an alignment along said second crosswalk during a movement of said advanced wireless push button based on said second receiver location information and said third receiver location information.

10. The method as in claim 8, wherein said advanced wireless push button is configured to take note of a location of a pole of an opposite end of said second crosswalk when a camera of said wireless push button is activated pointing toward said pole and then to continuously monitor an alignment along said second crosswalk during a movement of said advanced wireless push button with respect to a marking of said second crosswalk as captured by said camera and, upon detecting any deviation in said movement from an expected path, to trigger an alert to said user.

11. A method for registering pedestrian signal requests in an advanced accessible pedestrian system, said method comprising:

configuring an advanced wireless push button comprising a plurality of buttons and a plurality of wireless messages broadcasted by one or more receivers or retrieved from an advanced accessible pedestrian system server to dynamically dedicate one or more buttons of said plurality of buttons individually to a particular crosswalk of a traffic intersection;

enable a first button and a second button of said one or more buttons to recognize a first receiver code and a second receiver code respectively, wherein said first receiver code and said second receiver code are included in said plurality of wireless messages and said first receiver code is defined for a first crosswalk and said second receiver code is defined for a second crosswalk of said traffic intersection;

transmitting back, by said advanced wireless push button, said first receiver code on an activation of said first button, or said second receiver code on an activation of said second button, by a user for making a request for a pedestrian signal corresponding to said first crosswalk or to said second crosswalk;

determining, by said first receiver, on receipt of said first receiver code, a status of said pedestrian signal corresponding to said first crosswalk, or by said second receiver, on receipt of said second receiver code, a status of said pedestrian signal corresponding to said second crosswalk; and registering said request for said pedestrian signal, corresponding to said first crosswalk if a walk signal of said pedestrian signal for said first crosswalk is not on, or corresponding to said second crosswalk if a walk signal of said pedestrian signal for said second crosswalk is not on.

12. The method as in claim 11, wherein, on said activation of said second button on continuous basis and on finding said walk signal for said second crosswalk on, said advanced wireless push button checks an alignment of said advanced wireless push button with respect to a second receiver location coordinates included in said plurality of wireless messages and a third receiver location coordinates included in said plurality wireless messages during a movement of said advanced wireless push button along said second crosswalk, said second receiver location coordinates and said third receiver location coordinates being location coordinates of said second receiver and a third receiver respectively installed at opposite ends of said second crosswalk.

13. The method as in claim 11, wherein said advanced wireless push button is an application based advanced push button and said plurality of buttons are descriptive buttons displayed by said application based advanced push button.

14. The method as in claim 11, wherein said activation of said first button or said activation of said second button is done through voice command.

15. The method as in claim 11, wherein said advanced wireless push button retrieves said plurality of wireless messages from said advanced accessible pedestrian system server based on a location coordinates of said advanced wireless push button.

16. A system for registering pedestrian signal requests, said system comprising:

one or more receivers configured to broadcast a plurality of wireless messages, wherein a first field of a first receiver location information message included in said plurality of wireless messages is occupied by a first receiver code defined for a first receiver corresponding to a first crosswalk of a traffic intersection and a second field of said first receiver location information message is occupied by a first special code corresponding to said first receiver; and an advanced wireless push button comprising a plurality of buttons configured to dynamically dedicate one or more buttons of said plurality of buttons individually to a particular crosswalk of said traffic intersection;

wherein, a first button of said plurality of buttons is enabled to identify a wireless message of said plurality of messages to be said first receiver location information message if said first receiver code is found in said first field, so that, on activation of said first button said advanced wireless push button transmits back said first receiver code and, on receipt of said first receiver code, said first receiver registers a request for a pedestrian signal for said first crosswalk if a don't walk signal of said pedestrian signal is found on for said first crosswalk.

17. The system as in claim 16, wherein a first field of a second receiver location information message included in said plurality of wireless messages is occupied by a second special code and a second field of said second receiver location information message is occupied by a second receiver code.

18. The system as in claim 17, wherein a second button of said plurality of buttons identifies a wireless message of said plurality of wireless messages to be said second receiver location information message if said second receiver code is found in said second field on activation of said second button.

19. The system as in claim 16, wherein said plurality of wireless messages are retrieved from an advanced accessible pedestrian system server based on location coordinates of said advanced wireless push button.

20. The system as in claim 16, wherein said advanced wireless push button provides one or more types of alerts for maintaining an alignment of movement of said advanced wireless push button along a second crosswalk based on a second receiver location coordinates and a third receiver location coordinates obtained from said plurality of wireless messages, said second receiver location coordinates and said third receiver location coordinates being location coordinates of a second receiver and a third receiver installed respectively at opposite ends of said second crosswalk.

* * * * *